US007121324B2

(12) United States Patent
Jacobson et al.

(10) Patent No.: US 7,121,324 B2
(45) Date of Patent: Oct. 17, 2006

(54) DEVICE FOR CASTING OF METAL

(75) Inventors: Nils Jacobson, Stockholm (SE); Erik Svensson, Västerås (SE)

(73) Assignee: ABB AB, Västerås (SE)

( * ) Notice: Subject to any disclaimer, the term of this patent is extended or adjusted under 35 U.S.C. 154(b) by 0 days.

(21) Appl. No.: 10/502,203

(22) PCT Filed: Jan. 16, 2003

(86) PCT No.: PCT/SE03/00065

§ 371 (c)(1),
(2), (4) Date: Mar. 8, 2005

(87) PCT Pub. No.: WO03/061877

PCT Pub. Date: Jul. 31, 2003

(65) Prior Publication Data

US 2005/0155739 A1 Jul. 21, 2005

(30) Foreign Application Priority Data

Jan. 24, 2002 (SE) ..... 0200188

(51) Int. Cl.
*B22D 27/02* (2006.01)

(52) U.S. Cl. ..... 164/502; 164/418

(58) Field of Classification Search ..... 164/418, 164/502, 503, 504

See application file for complete search history.

(56) References Cited

U.S. PATENT DOCUMENTS 3,525,380 A * 8/1970 Moore ..... 164/48
4,577,676 A * 3/1986 Watson ..... 164/468
4,796,687 A * 1/1989 Lewis et al. ..... 164/455
6,050,324 A * 4/2000 Jolivet et al. ..... 164/415
6,443,221 B1 * 9/2002 Suzuki et al. ..... 164/502

FOREIGN PATENT DOCUMENTS

| | | |
|---|---|---|
| DE | 2838564 A1 | 3/1979 |
| EP | 1033189 A3 | 4/2001 |
| WO | WO 99/44771 A1 | 9/1999 |

* cited by examiner

*Primary Examiner*—Len Tran
(74) *Attorney, Agent, or Firm*—Venable LLP; Eric J. Franklin

(57) ABSTRACT

A device for continuous or semi-continuous casting of metal comprising a mould having a number of mould elements (1, 2) which together form a mould adapted for receiving a liquid metal (6), a mould supporting structure (30, 31) surrounding the mould and mechanically supporting it, and an induction coil (20) arranged close to the mould for reducing the contact pressure between the melt and the mould. At least one of the mould elements is divided into at least a first (1*a*, 2*a*) and a second (1*b*, 2*b*) part arranged so that they are electrically insulated from each other, the first mould element part being arranged before the second mould element part relative to the casting direction and said induction coil is arranged close to the first mould element part (1*a*, 2*a*).

24 Claims, 2 Drawing Sheets

DEVICE FOR CASTING OF METAL

TECHNICAL FIELD

The present invention relates to a device for continuous or semi-continuous casting of metal, comprising a mould with a number of mould elements which together form a casting mould adapted to receive a liquid metal, a mould supporting structure that surrounds the mould and mechanically supports it, and an induction coil arranged adjacent to the mould to reduce the contact pressure between the melt and the mould. The device is used to advantage in continuous casting of metal or metal alloys to form an elongated casting, a so-called cast strand.

BACKGROUND ART

In continuous or semi-continuous casting of metals and metal alloys, a hot melt is supplied to a chilled mould intended for continuous casting, that is, a mould that is open in both ends in the casting direction. The mould is normally water-cooled and surrounded and supported by a supporting structure. Usually, the supporting structure comprises supporting beams or supporting plates provided with inner cavities or channels for a coolant, such as water. The melt is supplied to the mould, whereby the metal solidifies and a cast strand is formed when it passes through the casting mould. When the cast strand passes out of the mould, it comprises a solidified self-supporting shell around a remaining melt.

To prevent the cast strand from adhering to the mould wall, an oscillatory motion is imparted to the mould. To further prevent the solidified self-supporting shell from adhering to the mould wall, a lubricant is usually supplied to the upper surface of the melt in the mould. Through the oscillations, so-called oscillation marks arise on the surface of the cast strand. If the solidified surface layer should adhere to the mould, this manifests itself as considerable surface defects and in certain cases as a ripping of the solidified surface layer.

One known way of preventing the occurrence of oscillation marks on the cast strand is to make use of electromagnetic casting (EMC). During electromagnetic casting, an ac field generates forces acting to separate the melt and the mould and thus reduce the contact pressure between the melt and the mould. Because of these separating forces, the risk of adhesion and the risk of oscillation marks are reduced. Further, improved conditions for lubricating the mould are achieved. In this way, the surface fineness of the finished casting may be improved.

The ac field that is needed during electromagnetic casting is obtained from a coil arranged at the upper end of the mould. This coil may have one or more phases. Preferably, a high-frequency alternating magnetic field is applied. Usually, the inductive coil is fed with an alternating current with a fundamental frequency of 50 Hz or more. For slabs, the frequency is preferably in the interval of 50–1000 Hz, but higher frequencies are feasible. The compressive forces that are generated by the high-frequency magnetic field reduce the pressure between the mould wall and the melt, whereby the conditions for lubrication are considerably improved. The surface quality of the cast strand is improved and the casting speed may be increased without jeopardizing the surface quality. A disadvantage that has occurred in connection with electromagnetic casting is that the induced power losses become very high.

A typical mould for casting of large castings comprises four plates made of copper or a copper alloy which together form a casting mould. These plates are supported by a supporting structure of plates and/or beams. To reduce the inductive power losses, it is known to use stainless steel in this supporting structure, but the power losses are still significant.

Swedish patent document No. 512691 discloses a device for casting of metal, where the power induced in the supporting beams and supporting plates of the mould is reduced, which in turn results in the total induced power losses being reduced. The disclosed device comprises a mould, an induction coil arranged at the upper end of the mould, and a mould supporting structure to mechanically support the mould. The mould comprises a number of mould elements, which are separated by means of partitions, each of which comprises an electrically insulating barrier. Each mould element is associated with a corresponding mechanically supporting mould supporting structure part and an electric conductor with an electrical conductivity that is higher than the electrical conductivity of the supporting structure.

The electric conductor is arranged close to the mould supporting structure part on that side of the mould supporting structure part that faces away from the mould. The barriers in the partitions break the current paths for the electric currents that are induced in the mould by the magnetic field, whereby the penetration of the melt by the magnetic field is facilitated and the induction power losses in the mould are minimized. The electric conductor provides an advantageous return path for the current that is induced by the high-frequency magnetic field, such that the induced power losses are minimized in the supporting structure. Admittedly, this mould arrangement reduces the induced power losses, but still the induced power losses are too high.

SUMMARY OF THE INVENTION

The object of the present invention is to provide a device for continuous or semi-continuous casting of metal which, by using electromagnetic casting, improves the conditions for the initial solidification of the cast strand and which exhibits low induced power losses.

This object is achieved with the device described in the introductory part of the description, which is characterized in that at least one of the mould elements is divided into at least a first and a second part, arranged so as to be electrically insulated from each other, whereby the first mould element part is arranged before the second mould element part relative to the casting direction and said inductive coil is arranged close to the first mould element part.

An analysis of the currents that are induced by the coil has shown that the induced current on the outside of the mould is concentrated at a band right in front of the coil, whereas the induced current on the inside of the mould is essentially evenly distributed along the height of the entire mould. This even distribution of the current in the vertical direction on the inside of the mould results in the magnetic field in the space formed between the mould and the melt being substantially constant from the lower edge of the mould to the surface of the melt, the so-called meniscus. Thus, the electromagnetic pressure becomes essentially constant over the entire mould height. Such a distribution of the current becomes inefficient for two reasons: first, because only the electromagnetic pressure in the region nearest below the meniscus can be utilized, and, second, because the electromagnetic pressure is inversely proportional to the propagation of the current in the vertical direction. This implies that the higher the mould is, the smaller will be the electromagnetic pressure. Currently, the trend is to increase the length of the mould, which means that the effect of the magnetic field is reduced.

By dividing the mould, vertically, into at least two parts which are electrically insulated from each other, and arranging the inductive coil close to the one of the mould parts, the propagation of the induced current in the vertical direction on the inside of the mould can be limited to a region around the meniscus, hence reducing the induced power losses. An improvement of the efficiency is attained even when dividing one or a few of the mould elements. One advantage of the present invention is that the electromagnetic pressure remains the same irrespective of the length of the mould.

According to a preferred embodiment of the invention, the first and second mould element parts are arranged spaced from each other, so that a gap is formed between them, and that the gap is arranged substantially across the casting direction. The mould element is divided by a gap preventing the induced currents from reaching the lower part of the mould element. The gap is advantageously filled with some insulating material, but it may also be filled with air.

According to another preferred embodiment of the invention, the gap is arranged at a distance from the lower edge of the coil that is smaller than 15 cm. With this arrangement, and provided that the coil is arranged essentially on a level with the meniscus, a concentrated magnetic field, and hence high inwardly directed forces, are exerted on the melt where it is really needed, that is, in the vicinity of the meniscus.

According to one embodiment of the invention, the divided mould element constitutes at least one side in the casting mould, and the gap is arranged such that the position of the gap in relation to the coil varies along the side of the mould. Instead of having a purely horizontal gap, the position of the gap may be allowed to vary in the vertical direction. In this way, it is possible, at least to a certain extent, to control the distribution of the electromagnetic pressure on the melt along the sides of the mould.

According to one embodiment of the invention, the gap has an irregular shape, in a section across its longitudinal axis, to bring about a locking in the lateral direction of the first and the second mould element parts against each other. According to a further embodiment of the invention, the gap is arranged, in a section across its longitudinal axis, to be inclined in relation to a plane across the casting direction. One of the tasks of the mould is to retain the cast strand and hence the mould elements are sometimes subjected to large outwardly-directed forces. To prevent the mould element parts from sliding apart, the gap is advantageously formed, in the cross section across the thickness of the mould, with an oblique or irregular shape, or formed with slots to lock the mould element parts to each other.

According to a further embodiment of the invention, the mould comprises four mould elements in the form of mould plates, two of the mould plates constituting the long sides of the casting mould and the other two mould plates constituting the short sides of the casting mould, and at least the two mould plates that constitute the long sides of the casting mould are divided into said first and second mould element parts. Preferably, the two mould plates that constitute the short sides of the casting mould each consist of one coherent part. Dividing only the long sides of the mould, while leaving the two short sides undivided, has the advantage that the mould manages the above-mentioned outwardly-directed forces in a better way when two sides are undivided while at the same time the improvement of the efficiency becomes almost as high as when all the sides are divided.

According to an additional embodiment of the invention, the mould supporting structure comprises a number of mould supporting members which are each arranged to support one of said mould elements, whereby the mould supporting member that is arranged to support said divided mould element is divided, in the-same way as the mould element, into a first and a second mould supporting part electrically insulated from each other, the first mould supporting part being arranged to support the first mould element part and the second mould supporting part being arranged to support the second mould element part. The currents that are induced by the coil are induced not only in the mould elements but also in the surrounding supporting structure. To further reduce the induced power losses, also the surrounding supporting structure is divided in the same way as the mould.

According to another embodiment of the invention, the mould supporting structure comprises a number of mould supporting parts, each one arranged to support any of said mould element parts, whereby the mould supporting part that is arranged to support said divided mould element part consists of a coherent part that supports both the upper and the lower mould element part. By dividing only the mould element and not the mould supporting member that supports the mould element parts, a better mechanical stability in the mould is obtained.

According to a further embodiment of the invention, said divided mould element is divided into at least three parts, the third mould element part being arranged before the first mould element part relative to the casting direction and electrically insulated from the first mould element part. The third and first mould element parts are advantageously arranged spaced from each other so as to form a gap between them and so that the gap is arranged substantially transversely of the casting direction. By introducing a third division in the upper part of the mould, the propagation of the induced current in the vertical direction is limited further to the region around the meniscus. This second gap may be given varying shapes, described above for the first gap.

According to an additional embodiment of the invention, the mould elements are arranged electrically insulated from each other and an electric conductor with a higher electrical conductivity than the electrical conductivity of the supporting structure is arranged on that side of the mould supporting structure that faces away from the mould. To reduce the power losses further, the divided mould according to the invention may be provided with an electric conductor arranged on the outside of the supporting structure. The electric conductor constitutes an advantageous return path for the current and hence minimizes the induced power losses in the supporting structure.

BRIEF DESCRIPTION OF THE DRAWINGS

The present invention will now be explained by means of different embodiments, described as examples, and with reference to the accompanying drawings.

DESCRIPTION OF PREFERRED EMBODIMENTS

A mould for continuous casting is open at both ends in the casting direction and comprises means for ensuring that the formed cast strand continuously leaves the mould. The mould is continuously supplied with a flow of hot molten metal.

While the melt passes through the mould, it is cooled and solidifies at least partly, whereby a cast strand is formed.

Figure 1:
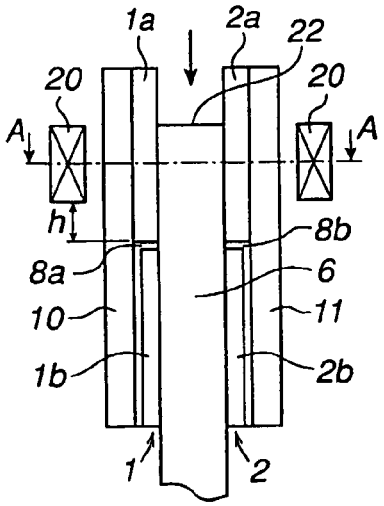
FIG. 1 is a section along the casting direction through a device for continuous casting according to a first embodiment of the invention.
Figure 2:
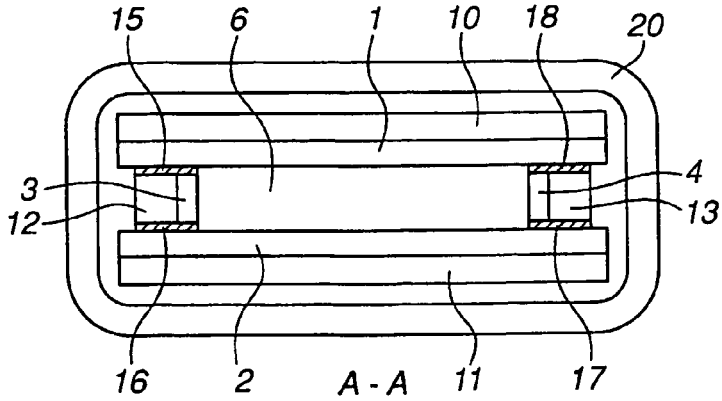
FIG. 2 is a section A—A across the casting direction through the device of FIG. 1.

FIGS. 1 and 2 show a device for continuous casting of metal. The device comprises a mould, which comprises a number of mould elements 1, 2, 3 and 4 which together form a casting mould arranged to receive a liquid metal 6. The mould elements 1–4 are plate-formed and will be designated mould plates in the following. A mould plate is usually made of copper or a copper-based alloy, which may be provided with a coating on the inner surface which faces the melt during operation. The mould plates 1 and 2 also face each other and constitute short sides in the casting mould. Further, the mould plates exhibit a high thermal and electrical conductivity. The cooling plates are provided cooling channels (not shown).

Each one of the mould plates 1 and 2, which constitute long sides in the casting mould, is divided into two parts, a first mould element part 1*a*, 2*a*, and a second mould element part 1*b*, 2*b*. The first mould element part 1*a*, 2*a* is arranged before the second mould element part 1*b*, 2*b*, as viewed relative to the casting direction. The first mould element parts 1*a*, 2*a* are arranged to be electrically insulated from the second mould element parts 1*b*, 2*b*. The first mould element parts 1*a*, 2*a* are preferably arranged on a level with the upper surface of the melt, the meniscus 22.

The first mould element part 1*a* is arranged at a distance from and above the second mould element part 1*b*, in such a way that a gap 8*a* is formed between the mould element parts. In a corresponding way, the first mould element part 2*a* is arranged at a distance from and above the second mould element part 2*b*, thus forming a gap 8*b* therebetween. The gaps 8*a*, 8*b* are arranged substantially transversely of the casting direction. During continuous casting, the casting direction is preferably vertical, which means that the gap is preferably arranged horizontally. The gaps 8*a*, 8*b* are preferably filled with some insulating material, for example glass fibre-reinforced epoxy, but the gap may also be an air gap.

The mould plates 3, 4, which constitute short sides in the casting mould, may either be divided into a first and a second mould element part, in the same way as the mould plates 1, 2, or each one of the mould plates 3, 4 may consist of one single coherent part. Usually, the height/width ratio for the short sides is such that a division of the mould plates 3, 4 only provides a marginal improvement of the efficiency. From the point of view of strength, it is therefore better only to divide the mould plates 1, 2 that constitute the long sides.

The mould is surrounded by a mould supporting structure that mechanically supports the mould. The mould supporting structure comprises a number of mould supporting members 10, 11, 12, 13 in the form of mould supporting plates, which are each arranged to support one of the mould plates 1, 2, 3, 4. The mould supporting plates 10, 11, 12, 13 are usually made of steel girders and comprise internal channels or cavities for a flowing coolant such as water. The mould plates 1, 2, 3, 4, with the corresponding mould supporting plates 10, 11, 12, 13, are arranged to be electrically insulated from one another with the aid of partitions 15, 16, 17, 18. The mould supporting plates 10, 11, 12, 13 are preferably made from stainless steel to minimize the induced power losses.

The mould plates 1, 2, 3, 4 and the mould supporting plates 10, 11, 12, 13 are surrounded by an induction coil 20. The coil 20 is preferably arranged at the upper end of the mould on a level with the meniscus 22. The coil 20 is arranged so as to generate and apply a high-frequency alternating magnetic field acting on the melt 6 in the upper end of the mould during casting. The magnetic field, in turn, generates compressive forces on the melt which thereby reduces the pressure between the mould plates 1, 2, 3, 4 and the melt 6. For casting of slabs, the frequency of the magnetic field is preferably in the interval of 50–1000 Hz, but higher frequencies are feasible. The coil 20 is usually a single-phase coil and has an extent in the casting direction that is about 15 cm. To obtain improved efficiency, the gaps 8*a*, 8*b* should be arranged at a distance h from the lower edge of the coil which is smaller than 15 cm. To further concentrate the electromagnetic field and hence increase the efficiency, it is advantageous to arrange the coils at a distance h from the lower edge of the coil which is smaller than 10 cm.

As will be clear from FIG. 1, the mould supporting plates 10, 11 are arranged on the outside of the mould plates in such a way as to extend along both the first 1*a*, 1*b* and the second 2*a*, 2*b* mould element part. The mould supporting plates 10, 11 make electrical contact with the first mould element parts 1*a*, 2*a*. The mould supporting plates 10, 11 and the second mould element parts 1*b*, 2*b* are arranged to be electrically insulated from each other. Thus, the mould plates 1, 2 are divided, whereas the supporting plates are undivided to provide better mechanical stability.

Figure 3:
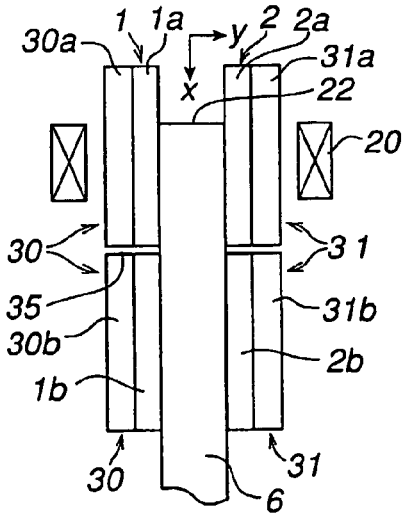
FIG. 3 is a section along the casting direction through a device for continuous casting according to a second embodiment of the invention.

FIG. 3 shows an alternative embodiment of a device for continuous casting of metal. It should be noted that components having a corresponding structure and function are provided with the same reference numerals in all the embodiments. The device in FIG. 3 differs from the device in FIG. 1 in that the mould supporting plates 30, 31, which are arranged to support the divided mould plates 1, 2, are divided, in the same way as the mould plates 1, 2, into a first mould supporting part 30*a*, 31*a* and a second mould supporting part 30*b*, 31*b* which are electrically insulated from each other. The first mould supporting part 30*a*, 31*a* is arranged to support the first mould element part 1*a*, 2*a* and the second mould supporting part 30*b*, 31*b* is arranged to support the second mould element part 1*b*, 2*b*.

The first mould supporting part 30*a* is arranged along the entire mould element part la and the mould supporting part 30*b* is arranged along the entire length of the mould element part 1*b*. The mould supporting part 30*a* and the mould element part 1*a* together form a first unit and the mould supporting part 30*b* and the mould element part 1*b* form a second unit, which units are arranged spaced from each other so as to form a gap 35 between them. The gap 35 is arranged substantially transversely of the casting direction. The mould element parts 2*a*, 2*b* and the mould supporting parts 31*a*, 31*b* are arranged in a corresponding way.

Figure 4A:
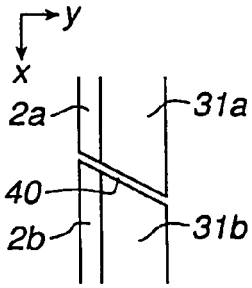
FIGS. 4*a*–4*b* show alternative embodiments of a gap between mould element parts in a cross section across the thickness of the mould.
Figure 4B:
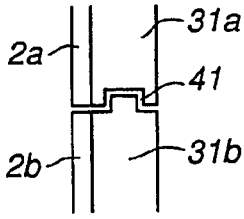

In the preceding embodiments, the gaps 8*a*, 8*b*, 35 were essentially horizontal in a section across their own longitudinal axes. To improve the mechanical strength, the gap may, for example, be formed as shown in FIGS. 4*a* and 4*b*. In FIG. 4*a*, a gap 40 that is inclined in relation to the horizontal plane, is shown. Such an inclined gap absorbs outwardly-directed forces from the melt that act in a separating way on the mould element parts. FIG. 4*b* shows a gap 41 that is provided with a slot to lock the first mould element part 2*a* and the corresponding mould supporting part 31*a* to the second mould element part 2*b* and the corresponding mould supporting part 31*b*.

Figure 5:
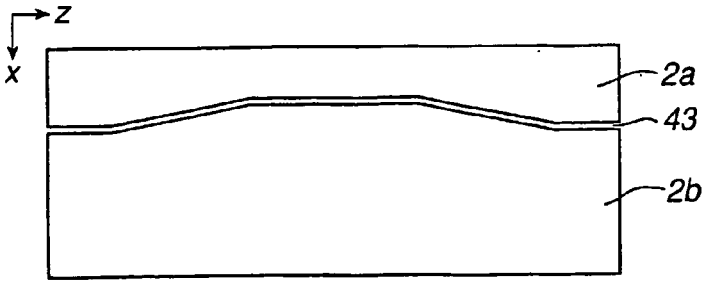
FIG. 5 shows an alternative embodiment of the gap, wherein the gap is arranged so that the position of the gap in relation to the upper end of the mould varies along the side of the mould.

As shown in FIG. 5, it is also possible to allow the position of the gap in the vertical direction to vary along the side of the mould. FIG. 5 shows a gap 43 between the mould element parts 2*a*, 2*b*, wherein the position of the gap along the side of the mould, in the z-direction in the figure, varies in relation to the lower side of the mould. In this way, it is possible to vary the distribution of the electromagnetic pressure on the melt along the side of the mould.

Calculations of the power have been carried out by means of a 3D FEM program, for solution of electromagnetic field problems, on a device intended for continuous casting with the strand dimension 2000×250 mm and with a mould height of 700 mm, according to the embodiment of the invention shown in FIG. 3. The calculations show that, at the same electromagnetic pressure on the melt at the meniscus, the total active power is reduced by about 44% compared with an undivided mould. At the same time, the reactive power is reduced by about 47%. For a device for casting according to the embodiment shown in FIG. 1, the corresponding figures are 25% and 28% for total active and reactive power, respectively.

Figure 6:
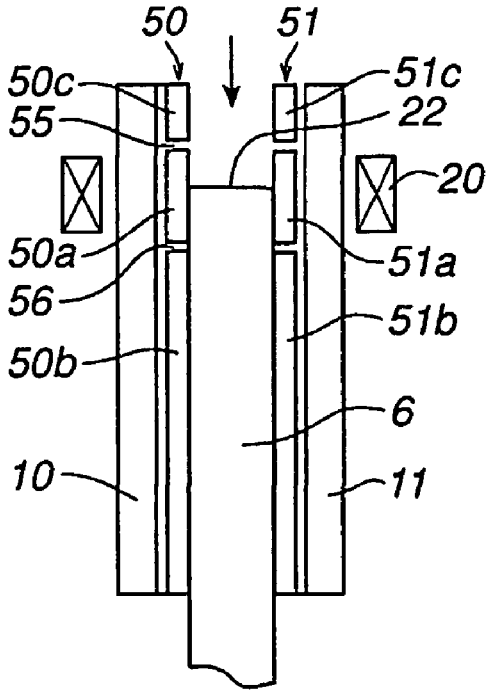
FIG. 6 is a section along the casting direction through a device for continuous casting according to a third embodiment of the invention.

To further limit the propagation of the induced current in the vertical direction to the region around the meniscus, the mould plates may be divided into more than two parts. FIG. 6 shows an embodiment, in which at least two of the mould plates 50, 51 are each divided into three mould element parts, a first mould element part 50*a*, 51*a*, a second mould element part 50*b*, 51*b* and a third mould element part 50*c*, 51*c*. The third mould element part 50*c*, 51*c* is arranged before the first mould element part 50*a*, 51*a*, viewed relative to the casting direction. The mould element parts 50*a*, 50*b*, 50*c* are arranged spaced from and electrically insulated from one another so as to form two gaps 55, 56.

Figure 7:
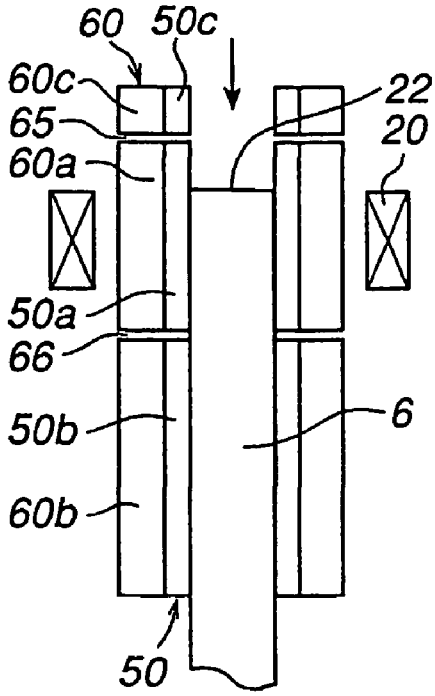
FIGS. 7 and 8 show further embodiments of a device for casting according to the invention.
Figure 8:
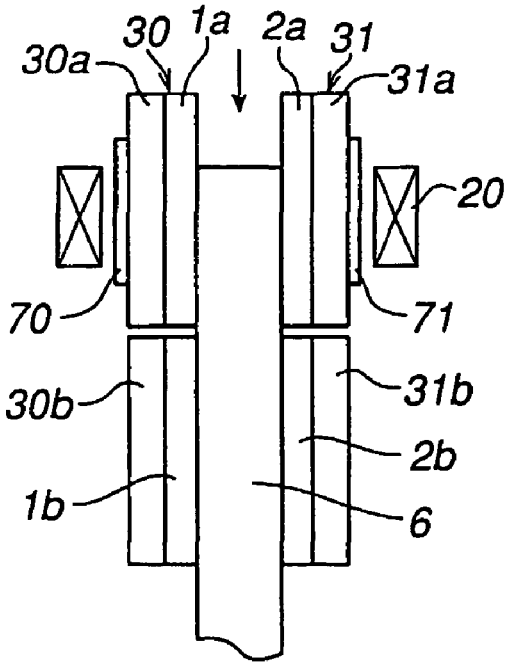

Thus, the mould plate 50 comprises two gaps 55, 56 arranged substantially transversely of the casting direction. In case of a vertical casting direction, the gaps are substantially horizontally arranged. The first gap 55 is arranged above the meniscus 22 and the second gap 56 is arranged below the meniscus 22. In this way, the propagation of the induced current is limited both upwardly and downwardly to the region around the meniscus 22. In the embodiment shown in FIG. 6, the mould supporting plates 10, 11 extend along all the three mould element parts 50*a*, 50*b*, 50*c*, 51*a*, 51*b*, 51*c*. FIG. 7 shows an alternative embodiment in which the mould supporting plates 60 are divided into three mould supporting parts 60*a*, 60*b*, 60*c*. The mould supporting parts 60*a*, 60*b*, 60*c* form, together with the mould element parts 50*a*, 50*b*, 50*c*, units which, as viewed in the casting direction, are arranged one after the other and spaced from each other so as to form gaps 65, 66 between them.

A casting device according to the invention may advantageously be provided with an electric conductor arranged close to the mould supporting structure. Electric conductors 70, 71, with a higher electrical conductivity than the electrical conductivity of the supporting structure, are arranged close to the first mould supporting parts 30*a*, 31*a*, on that side which faces away from the mould. The electric conductors 70, 71 provide advantageous return paths for the current that is induced by the high-frequency magnetic field so that the induced power losses are minimized in the supporting structure.

The invention is not limited to the embodiments shown, but may be varied and modified within the scope of the following claims. For example, the inductance coil may be replaced by several inductance coils.

The invention claimed is:

1. A device for continuous or semi-continuous casting of metal, comprising a mold with a number of mold elements, which together form a casting mold adapted to receive a liquid metal, a mold supporting structure which surrounds the mold and mechanically supports it, and an induction coil arranged close to the mold to reduce the contact pressure between the melt and the mold, wherein at least one of the mold elements is divided into at least a first and a second part arranged so as to be electrically insulated from one another, whereby the first mold element part is arranged before the second mold element part relative to the casting direction and said induction coil is arranged close to the first mold element part, wherein the first and the second mold element parts are arranged spaced from each other so as to form a gap between them and that the gap is arranged substantially transversely of the casting direction, and wherein the gap is arranged at a distance from the lower edge of the coil that is smaller than 15 cm.

2. The device for casting of metal according to claim 1, wherein the gap is filled with an insulating material.

3. The device for casting of metal according to claim 1, wherein said divided mold element constitutes at least one side of the casting mold and said gap is arranged so that the position of the gap in relation to the coil varies along the side of the mold.

4. The device for casting of metal according to claim 1, wherein the gap, in a section across its longitudinal axis, has an irregular shape to achieve locking in the lateral direction of the first and second mold element parts to each other.

5. The device for casting of metal according to claim 1, wherein the gap, in a section across its longitudinal axis, is arranged so as to be inclined in relation to a plane transversely of the casting direction.

6. The device for casting of metal according to claim 1, wherein the mold comprises four mold elements in the form of mold plates, whereby two of the mold plates constitute the long sides of the casting mold, and the other two mold plates constitute the short sides of the casting mold, and that at least the two mold plates that constitute the long sides of the casting mold are divided into said first and second mould element parts.

7. The device for casting of metal according to claim 6, wherein each one of the two mold plates that constitute the short sides of the casting mold consists of a coherent part.

8. The device for casting of metal according to claim 1, wherein the mold supporting structure comprises a number of mould supporting members, each one being arranged to support any of said mold elements, wherein the mold supporting member that is arranged to support said divided mold element is divided in the same way as the mold element into a first and a second mold supporting part, electrically insulated from each other, whereby the first mold supporting part is arranged to support the first mold element part and the second mold supporting part is arranged to support the second mold element part.

9. The device for casting of metal according to claim 1, wherein the mold supporting structure comprises a number of mold supporting parts, each one being arranged to support any of said mold elements parts, wherein the mold supporting part that is arranged to support said divided mold element consists of a coherent part supporting both the upper and the lower mold element parts.

10. The device for casting of metal according to claim 1, wherein said divided mold element is divided into at least three parts, whereby the third mold element part is arranged before the first mold element part relative to the casting direction and electrically insulated from the first mold element part.

11. The device for casting of metal according to claim 10, wherein the third and the first mold element parts are arranged spaced from each other so as to form a gap between them and that the gap is arranged substantially transversely of the casting direction.

12. The device for casting of metal according to claim 1, wherein the mold supporting structure comprises a number of mould supporting parts, each one being arranged to support any of said mold elements parts, wherein the mould elements are arranged to be electrically insulated from one another and that an electric conductor with a higher electrical conductivity than the electrical conductivity of the supporting structure is arranged on that side of the mold supporting structure that faces away from the mold.

13. A device for continuous or semi-continuous casting of metal, comprising a mold with a number of mold elements, which together form a casting mold adapted to receive a liquid metal, a mold supporting structure which surrounds the mold and mechanically supports it, and an induction coil arranged close to the mold to reduce the contact pressure between the melt and the mold, wherein at least one of the mold elements is divided into at least a first and a second part arranged so as to be electrically insulated from one another, whereby the first mold element part is arranged before the second mold element part relative to the casting direction and said induction coil is arranged close to the first mold element part, wherein the first and the second mold element parts are arranged spaced from each other so as to form a gap between them and that the gap is arranged substantially transversely of the casting direction, and wherein the gap, in a section across its longitudinal axis, is arranged so as to be inclined in relation to a plane transversely of the casting direction.

14. The device for casting of metal according to claim 13, wherein the gap is filled with an insulating material.

15. The device for casting of metal according to claim 13, wherein the gap is arranged at a distance from the lower edge of the coil that is smaller than 15 cm.

16. The device for casting of metal according to claim 13, wherein said divided mold element constitutes at least one side of the casting mold and said gap is arranged so that the position of the gap in relation to the coil varies along the side of the mold.

17. The device for casting of metal according to claim 13, wherein the gap, in a section across its longitudinal axis, has an irregular shape to achieve locking in the lateral direction of the first and second mold element parts to each other.

18. The device for casting of metal according to claim 13, wherein the mold comprises four mold elements in the form of mold plates, whereby two of the mold plates constitute the long sides of the casting mold, and the other two mold plates constitute the short sides of the casting mold, and that at least the two mold plates that constitute the long sides of the casting mold are divided into said first and second mould element parts.

19. The device for casting of metal according to claim 18, wherein each one of the two mold plates that constitute the short sides of the casting mold consists of a coherent part.

20. The device for casting of metal according to claim 13, wherein the mold supporting structure comprises a number of mould supporting members, each one being arranged to support any of said mold elements, wherein the mold supporting member that is arranged to support said divided mold element is divided in the same way as the mold element into a first and a second mold supporting part, electrically insulated from each other, whereby the first mold supporting part is arranged to support the first mold element part and the second mold supporting part is arranged to support the second mold element part.

21. The device for casting of metal according to claim 13, wherein the mold supporting structure comprises a number of mold supporting parts, each one being arranged to support any of said mold elements parts, wherein the mold supporting part that is arranged to support said divided mold element consists of a coherent part supporting both the upper and the lower mold element parts.

22. The device for casting of metal according to claim 13, wherein said divided mold element is divided into at least three parts, whereby the third mold element part is arranged before the first mold element part relative to the casting direction and electrically insulated from the first mold element part.

23. The device for casting of metal according to claim 22, wherein the third and the first mold element parts are arranged spaced from each other so as to form a gap between them and that the gap is arranged substantially transversely of the casting direction.

24. The device for casting of metal according to claim 13, wherein the mold supporting structure comprises a number of mould supporting parts, each one being arranged to support any of said mold elements parts, wherein the mould elements are arranged to be electrically insulated from one another and that an electric conductor with a higher electrical conductivity than the electrical conductivity of the supporting structure is arranged on that side of the mold supporting structure that faces away from the mold.

* * * * *